US012329329B2

(12) United States Patent
Dodge et al.

(10) Patent No.: US 12,329,329 B2
(45) Date of Patent: Jun. 17, 2025

(54) PORTABLE LIGHTWEIGHT TOILET SEAT SYSTEM

(71) Applicants: Leonard D. Dodge, Silverdale, WA (US); Marianne Sicilia, Silverdale, WA (US)

(72) Inventors: Leonard D. Dodge, Silverdale, WA (US); Marianne Sicilia, Silverdale, WA (US)

( * ) Notice: Subject to any disclaimer, the term of this patent is extended or adjusted under 35 U.S.C. 154(b) by 0 days.

(21) Appl. No.: 18/107,447

(22) Filed: Feb. 8, 2023

(65) Prior Publication Data

US 2024/0306864 A1 Sep. 19, 2024

Related U.S. Application Data

(60) Provisional application No. 63/308,661, filed on Feb. 10, 2022.

(51) Int. Cl.
*A47K 13/00* (2006.01)

(52) U.S. Cl.
CPC ..... *A47K 13/005* (2013.01)

(58) Field of Classification Search
CPC .... A47C 3/18; A47C 3/34; A47C 3/40; A47C 9/10; A47C 9/105; A47K 13/005; A47K 11/02; Y02A 50/30
See application file for complete search history.

(56) References Cited

U.S. PATENT DOCUMENTS

| | | | | |
|---|---|---|---|---|
| 444,621 | A * | 1/1891 | Schneiderr | A45B 5/00 135/66 |
| 2,877,828 | A * | 3/1959 | Barnette, Jr. | A01K 97/10 248/533 |
| 6,378,142 | B1 * | 4/2002 | Gray | A47K 11/02 4/449 |
| 7,950,085 | B2 * | 5/2011 | McGovern | A01B 1/022 294/57 |
| 9,161,665 | B2 * | 10/2015 | Cahoon | A47K 11/02 |
| 10,863,734 | B1 * | 12/2020 | George | A47C 7/666 |
| 12,022,807 | B2 * | 7/2024 | Zehring | A01K 31/14 |
| 12,150,603 | B2 * | 11/2024 | Schum | A01B 1/02 |
| D1,067,393 | S * | 3/2025 | Zhu | D23/299 |

FOREIGN PATENT DOCUMENTS

KR 20180002021 U * 1/2018

* cited by examiner

*Primary Examiner* — Erin Deery
(74) *Attorney, Agent, or Firm* — Eric Hanscom

(57) ABSTRACT

A portable, lightweight toilet system is collapsible into the small pouch that is easily stored in the glove compartment of a vehicle or carried on a belt loop of an outdoor person. The device has a built-in shovel to dig cat holes and an LED to provide nighttime illumination. It allows outdoors people to go to the bathroom in relative comfort, carrying a minimum of gear. The device can be collapsed into a carrying bag and is easily carried in a backpack on a belt loop or in the glove compartment of the vehicle.

16 Claims, 14 Drawing Sheets

PORTABLE LIGHTWEIGHT TOILET SEAT SYSTEM

CROSS REFERENCE TO RELATED APPLICATIONS

This application claims priority back to U.S. Provisional Application No. 63/308,661, filed Feb. 10, 2022, the contents of which are incorporated into this Utility Patent Application.

STATEMENT REGARDING FEDERALLY SPONSORED RESEARCH OR DEVELOPMENT

This invention was not federally sponsored.

BACKGROUND OF THE INVENTION

Field of the invention: This invention relates to the general field of mechanical outdoor equipment, and more specifically to a portable toilet is collapsible and can be compacted into a small product and carried easily with a car's glove compartment or on a person's belt loop.

Brief Description of Invention. The present invention is a portable lightweight toilet system. The invention is designed to allow the outdoors person to relax and comfortably go to the bathroom while outdoors. This product will give major confidence to those who would normally fear being outdoors for an extended period of time or even stay home out of fear of having to go at all. This product is highly portable and weighs approximately 1 pound. It can be collapsed into a carrying bag that can be conveniently hung from a belt loop or in a vehicle's glove compartment.

Statement of the Problem. Many outdoorspeople have problems going to the bathroom outdoors. While there are some "camping toilets", most are either too large, too heavy, too bulky or difficult to store. They are generally the size of a 5 gallon bucket and, based upon that size, can be used only for tent- or car-camping as it is not reasonable to expect a hiker to carry a 5 gallon bucket just for using as a bathroom. Another problem with the prior art is that once a person uses the bucket, he/she still has to dispose of the waste, leaving the options of either bringing along a separate shovel to dig holes for human waste, or to pack it out. Neither is a desirable option as no hiker is going to want to haul along a 5-gallon bucket and a separate shovel, and packing out human waste would not be a pleasant, or sanitary, option for a hiker or backpacker.

The current invention provides just such a solution by having a portable lightweight toilet system that can be collapsed into a small bag. The bag is easily stored in the glove compartment of a vehicle or carried on a belt loop of an outdoor person. The toilet assembly has a built-in shovel to dig cat holes and an LED to provide nighttime illumination. It allows outdoors people to go to the bathroom in relative comfort when they are out in the wilderness.

The seat top is designed for comfortability and gives the user a secure feeling. It is designed to be sat on using one thigh and butt cheek. This allows the user to sit comfortably for an extended time and relax while going. The LED can be, optionally, powered by batteries and/or solar systems, and has an off and on switch. The seat has a pivot point that makes the seat adjustable for both the user and for rotating the seat into an upright configuration for each storage. The single stand allows are easy positioning on uneven terrain, as opposed to a tripod stand that would work only on even terrain.

STATEMENT OF THE INVENTION

The invention is a lightweight toilet system that is both portable and collapsible into the small pouch that is easily stored in the glove compartment of a vehicle or carried on a belt loop of an outdoor person. The device has a built-in shovel to dig cat holes and an LED to provide nighttime illumination It allows outdoors people to go to the bathroom in relative comfort. The device can be collapsed into a carrying bag and is easily carried in a backpack on a belt loop or in the glove compartment of the vehicle.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

One preferred form of the invention will now be described with reference to the accompanying drawings.

DETAILED DESCRIPTION OF THE FIGURES

The present invention is portable lightweight toilet system is collapsible into the small pouch that is easily stored in the glove compartment of a vehicle or carried on a belt loop of an outdoor person. The device has a built-in shovel to dig cat holes and an LED to provide nighttime illumination It allows outdoors people to go to the bathroom in relative comfort. The device can be collapsed into a carrying bag and is easily carried in a backpack on a belt loop or in the glove compartment of the vehicle.

Figure 1:
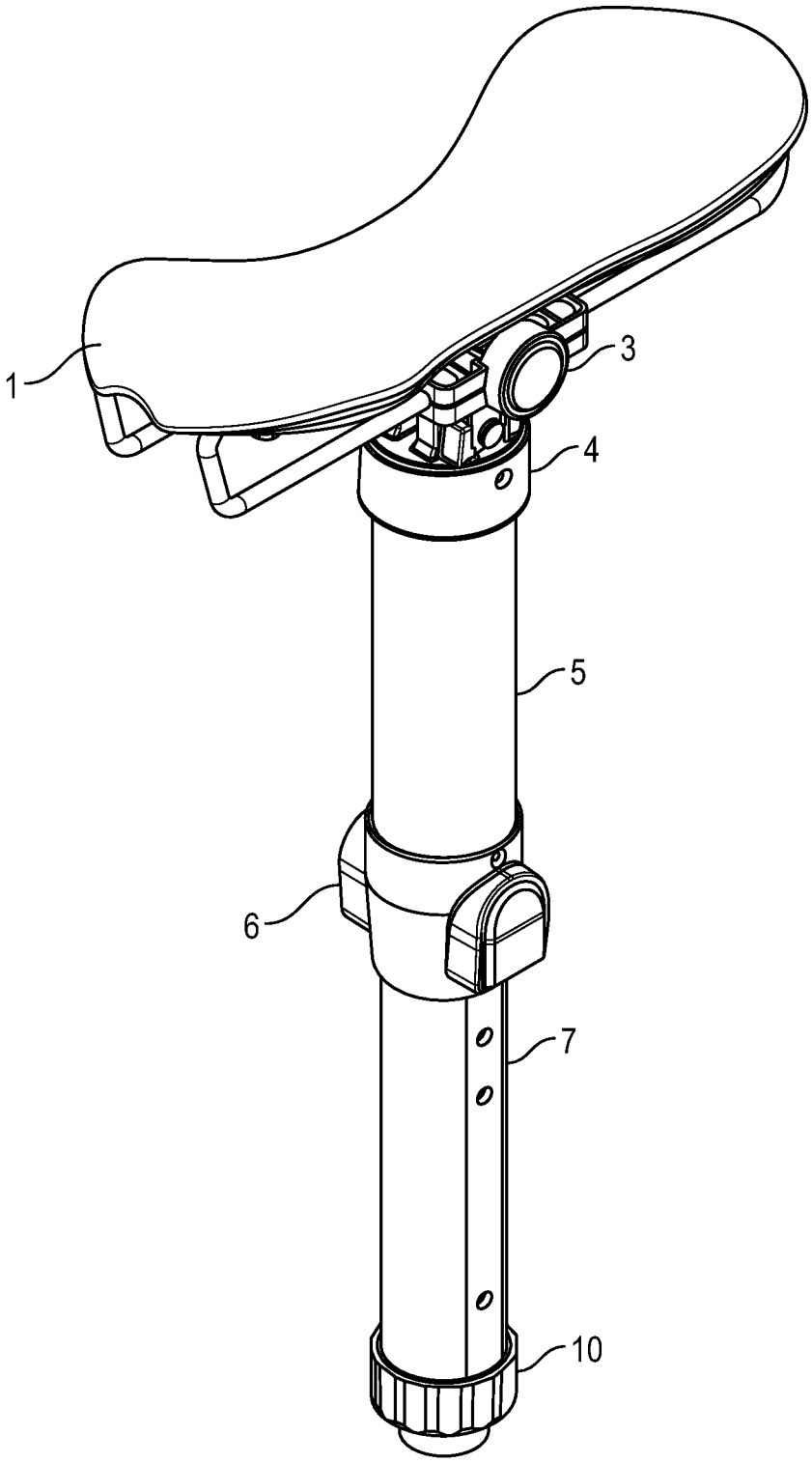
FIG. 1 is perspective view of the invention, showing the seat portion and the stand portion.

FIG. 1 is perspective view of the invention, showing the seat portion 1 and the stand portion 2 being rotationally connected to each other by a turning knob 3. This figure also shows that the stand portion 2 is divided into a stand top half 5 and a stand bottom half 7. A button 6 allows the stand portion 2 to adjust its height, as the top stand half 5 and the bottom stand half 7 are telescopically adjustable.

Figure 2:
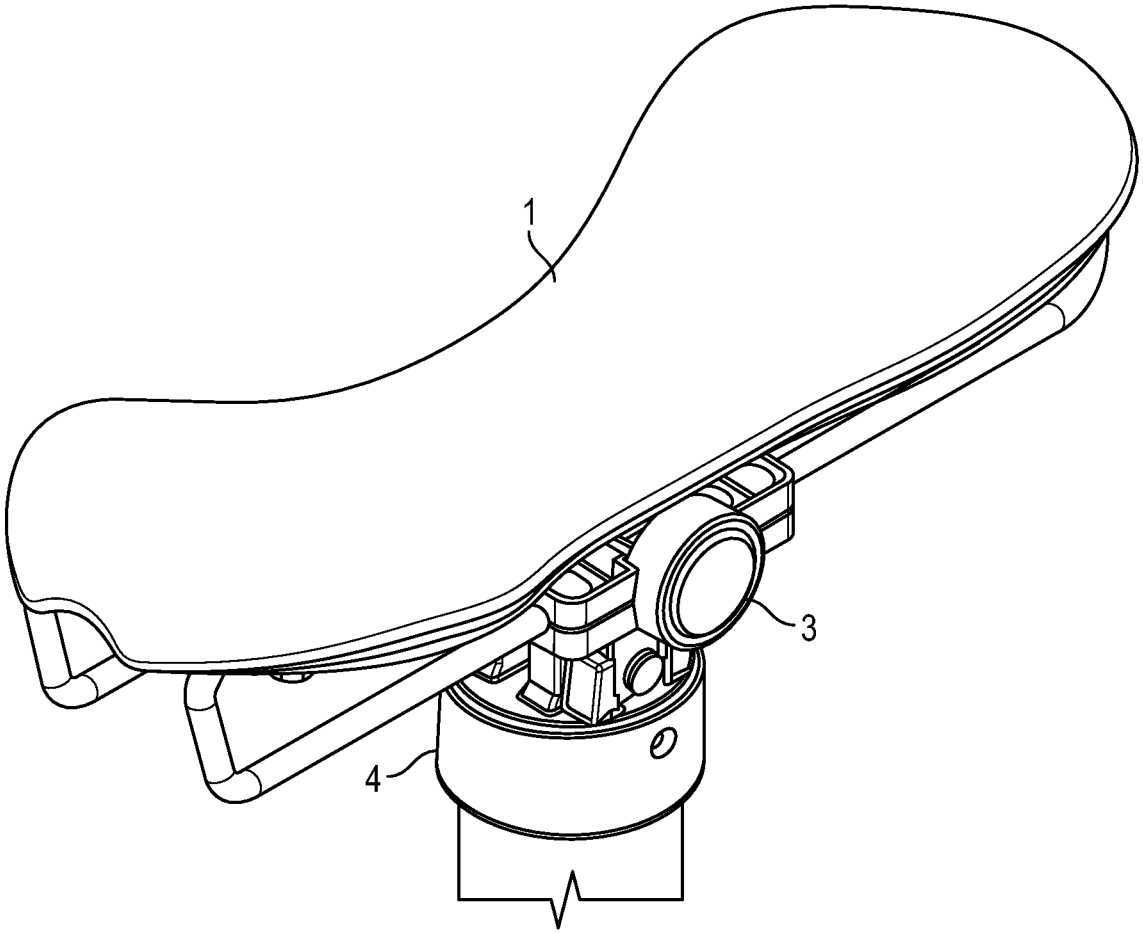
FIG. 2 is a perspective view of the seat portion of the invention, showing how it is connected to the stand portion.

FIG. 2 is a perspective view of the seat portion 1 of the invention, showing how it is connected to the stand portion 2 by the turning knob 3 which allows the seat portion 1 to rotate up and down around the stand portion 2. A locking ring 4 locks the seat portion 1 and the turning knob 3 to the stand portion 2. This rotation ability not always allows a user to adjust the angle of the seat for use, and also allows the seat portion to be turned all the way vertically for storage.

Figure 3B:
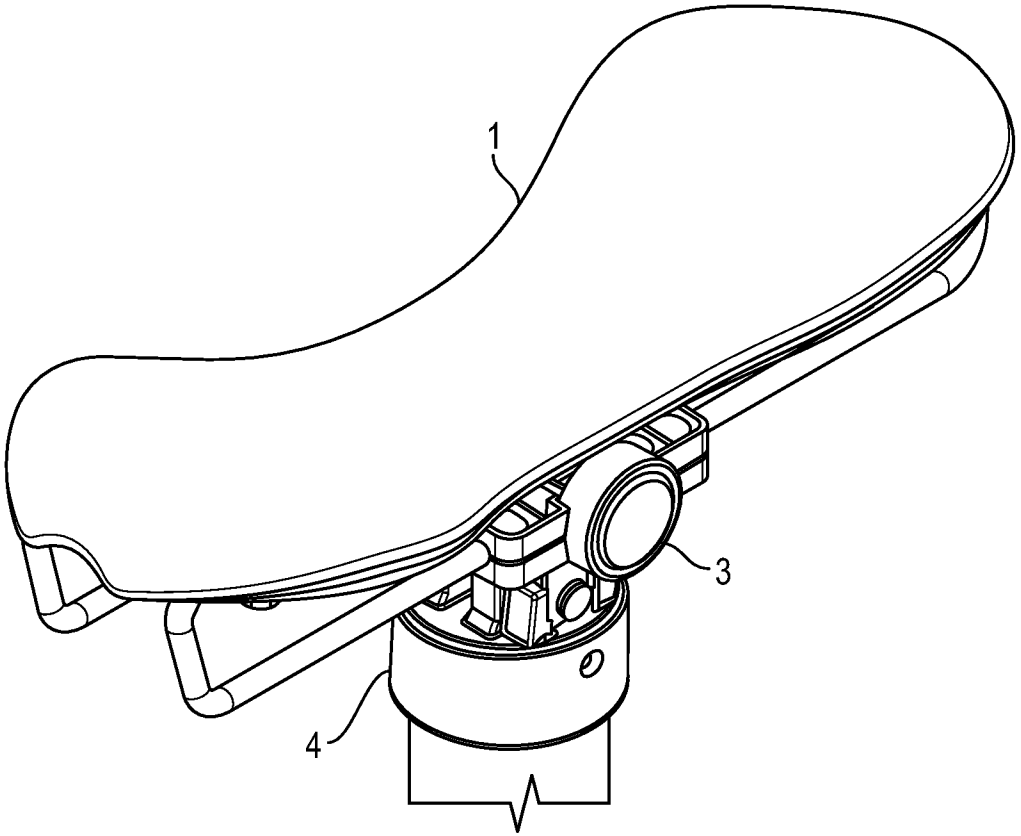
FIGS. 3A, 3B are side views of the invention.
Figure 3A:
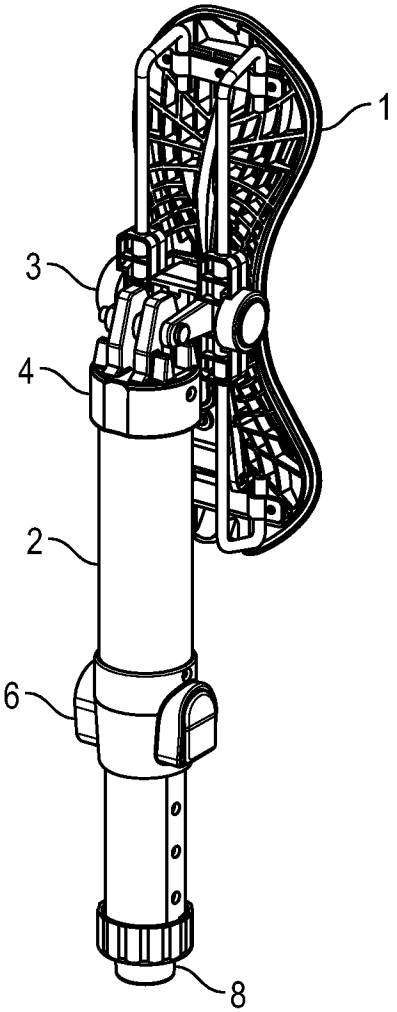

FIGS. 3A, 3B are side views of the invention. The stand portion 2 is fully compressed; the seat portion 1 has been rotated to be vertical, and the entire apparatus is ready to be inserted into the storage/carrying bag.

Figure 4:
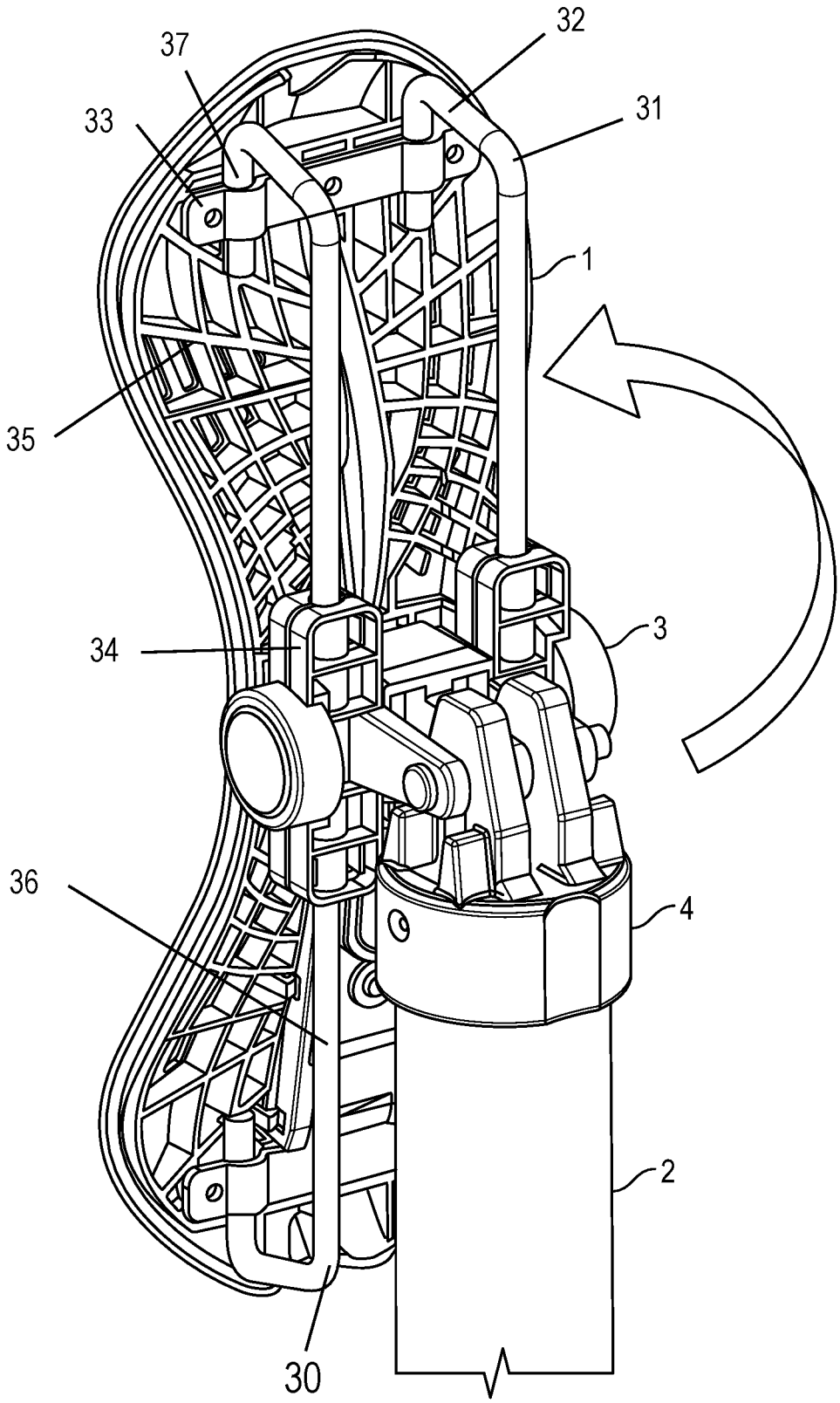
FIG. 4 is a side, perspective view of the connection point between the seat portion and the stand portion, and shows how it allows the seat portion to rotate.

FIG. 4 is a side, perspective view of the turning knob 3, which is the connection point between the seat portion 1 and the stand portion 2, and shows how it allows the seat portion to rotate. This figure also shows the underside of the seat having a support understructure 35 to provide strength to the sea. Adding further support to the seat are support rods 30, which extend from the retaining bracket 33 to the swivel bracket 34. Support rods 30 can be individual pieces, extending from on retaining bracket to the other, extending through the swivel bracket, or they can be individual pieces, with each extending from a retaining bracket to the swivel bracket, where they are secured. The support rods 30 have a flat rod portion 36, with a 90-degree connector 31, which turns into an upright rod 32, when then makes a second 90-degree bend, terminating in a catch 37.

Figure 5A:
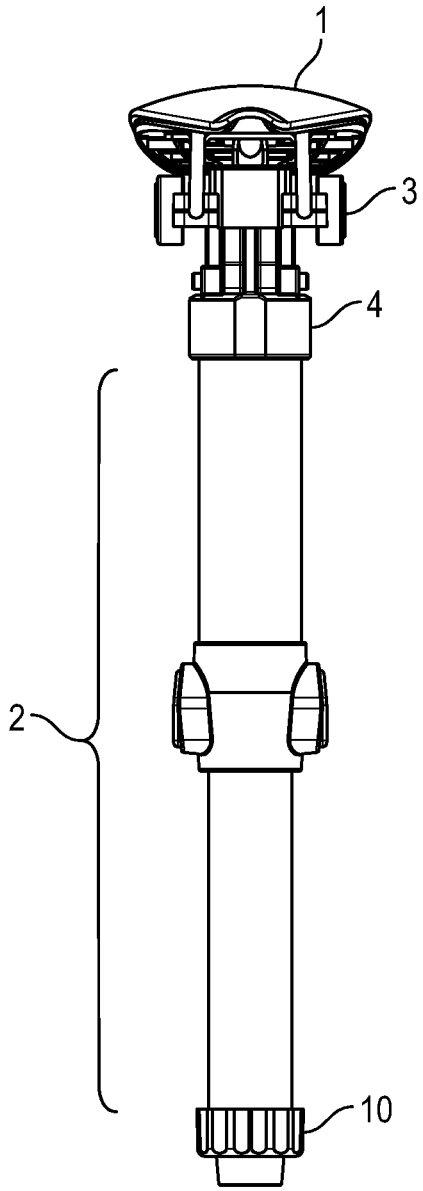
FIGS. 5A and 5B are front views of the invention.
Figure 5B:
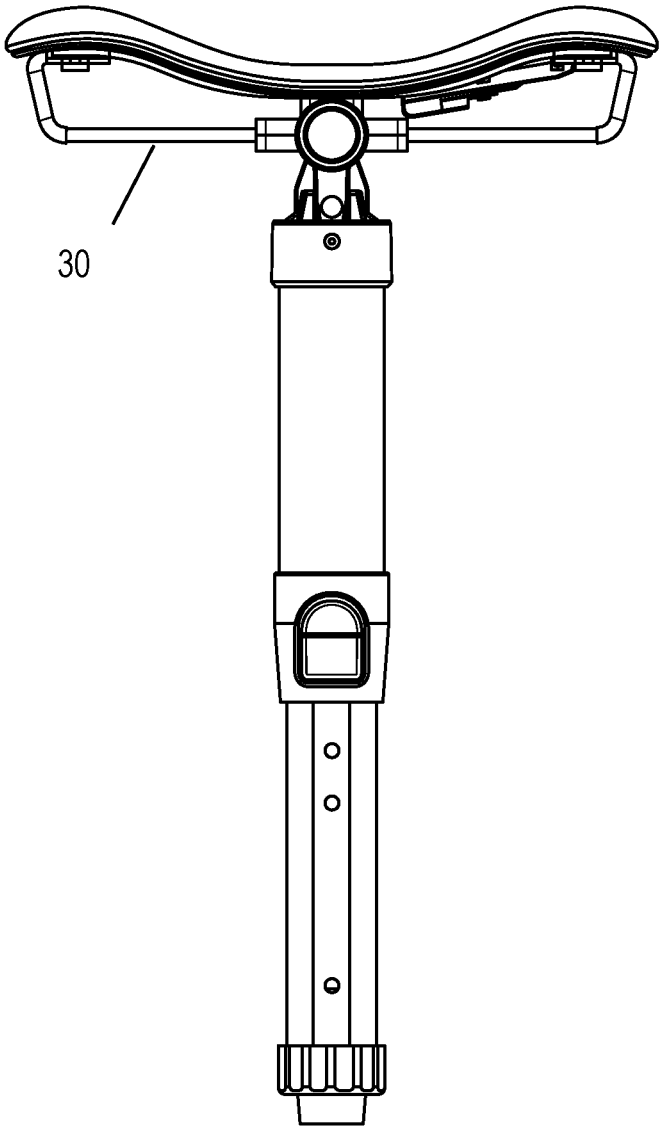

FIGS. 5A and 5B are front views of the invention, showing the seat portion 1 and the stand portion 2 being rotationally connected to each other by a turning knob 3. This figure also shows that the stand portion 2 is divided into a stand top half 5 and a stand bottom half 7. A button 6 allows the stand portion 2 to adjust its height, as the top stand half 5 and the bottom stand half 7 are telescopically adjustable.

Figure 6A:
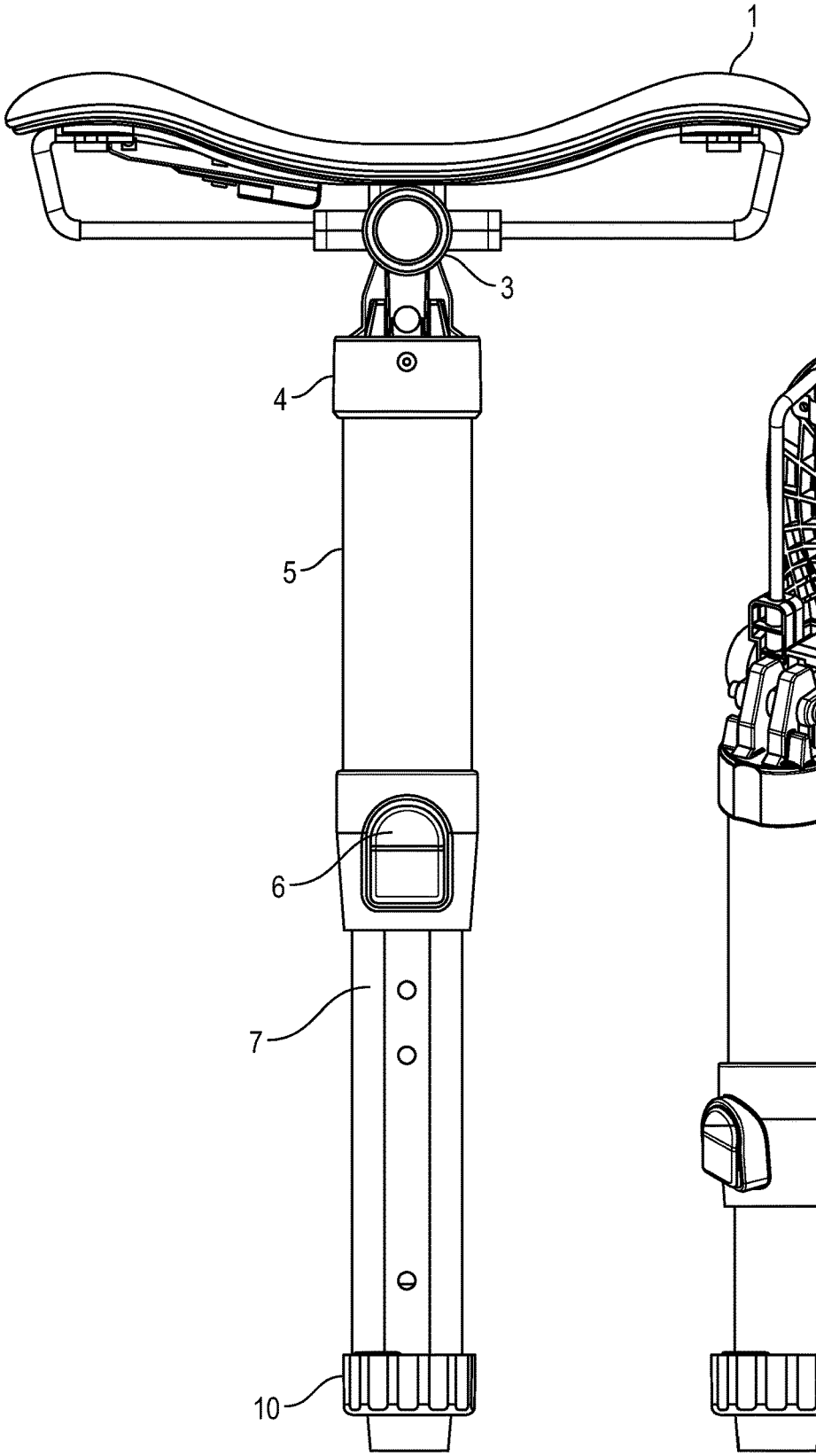
FIGS. 6A and 6B are side, perspective views of the invention in extended and collapsed configurations.
Figure 6B:
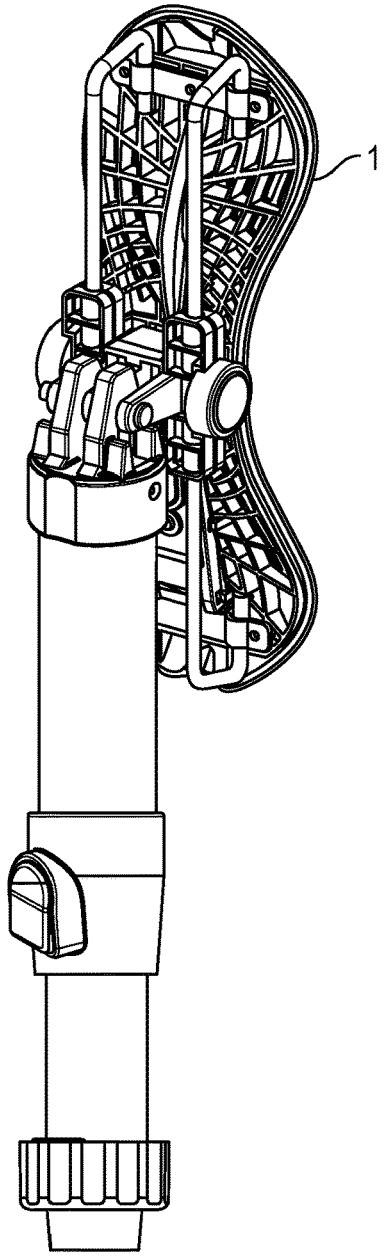

FIGS. 6A and 6B are side, perspective views of the invention in extended and collapsed configurations. The figure on the right is extended and ready to use, with the seat portion 1 horizontally oriented, the stand portion 2 fully extended with the stand top half 5 and the stand bottom half 7 having been moved to an extended configuration as the button 6 has been pushed as the stand bottom half 7 has been telescopically pull out of the stand top half 5.

Figure 7:
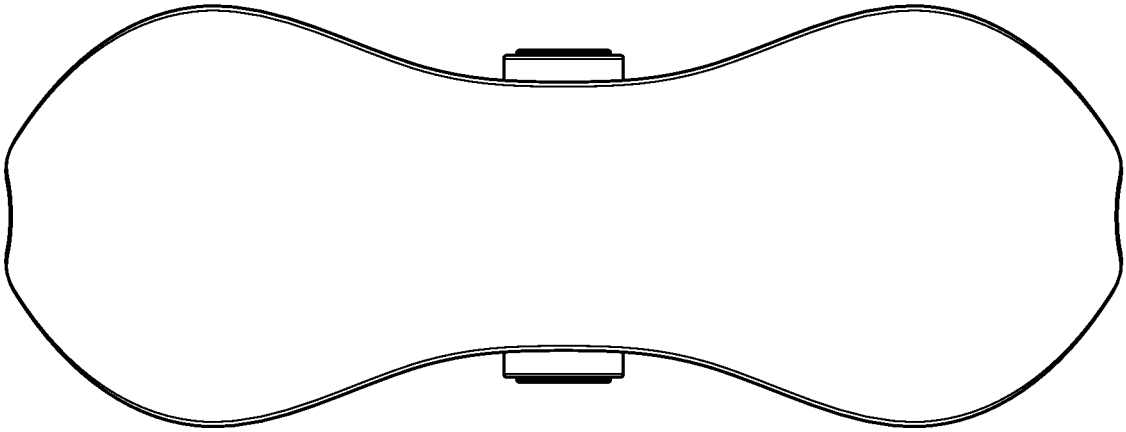
FIG. 7 is a top view of the invention.

FIG. 7 is a top view of the invention, showing how the seat portion 1 is ergonomically designed. The seat has a mesh design such that it provides adequate support, and at the same time is light weight.

Figure 8:
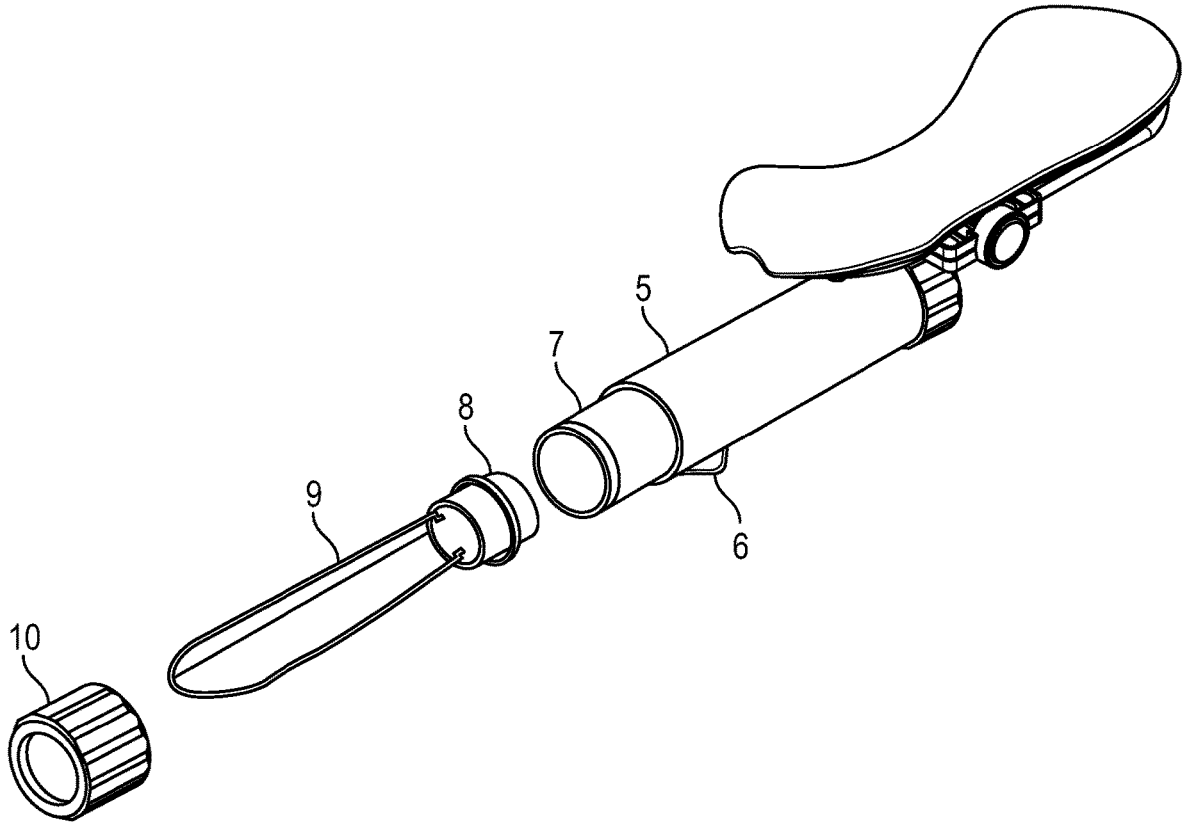
FIG. 8 is an exploded view of the invention showing the trowel being prepared to be removably attached to the stand portion.

FIG. 8 is an exploded view of the invention showing the trowel being prepared to be removably attached to the stand portion. In previous pictures, the rubber foot 8 of the trowel 9 has been the only part of this unit visible, but in this figure, the trowel apparatus has been removed from the stand bottom half 7. A locking ring 10 secures the rubber foot 8 in one configuration, and the trowel 9 in a second configuration to the stand portion.

Figure 9:
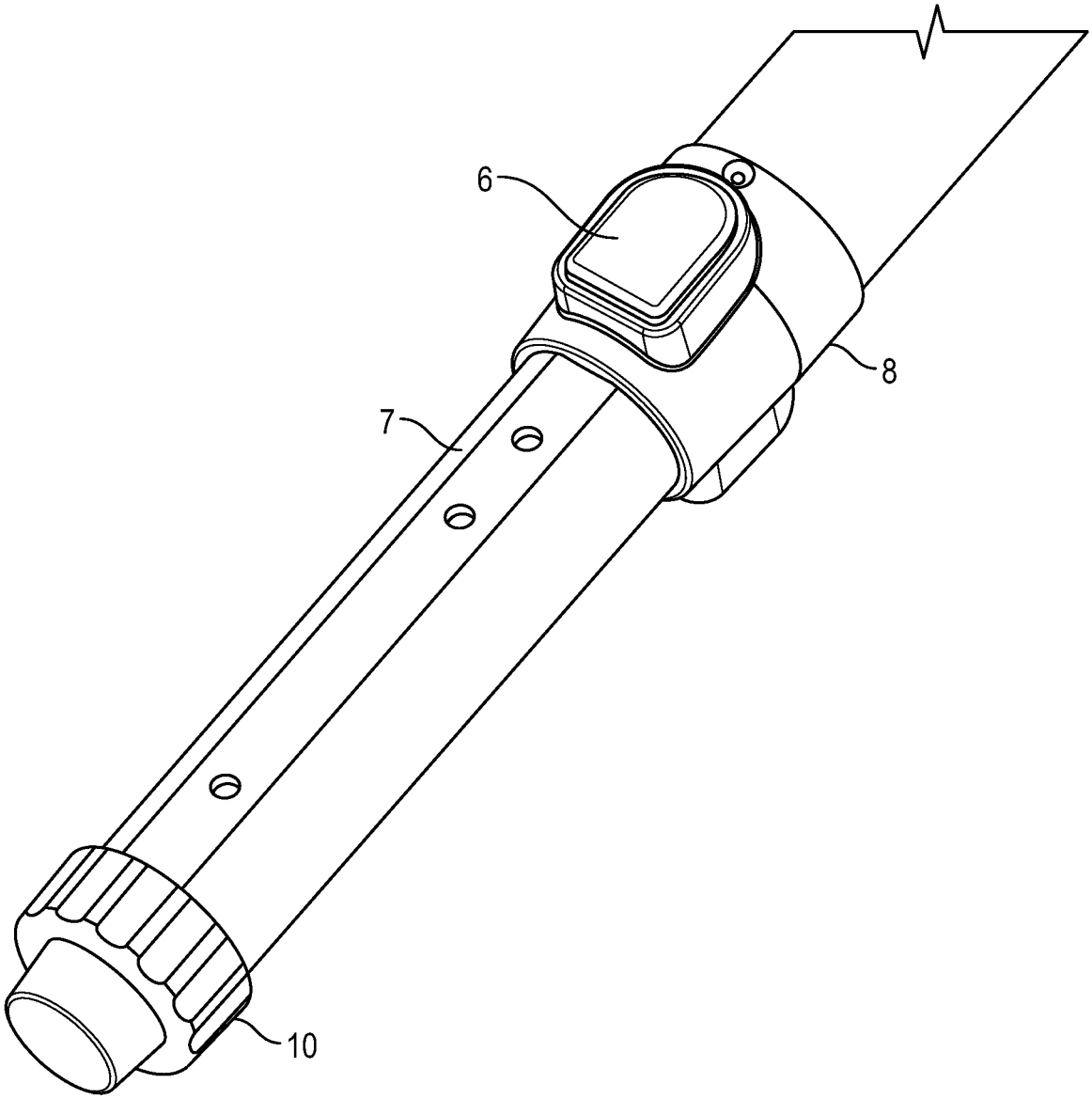
FIG. 9 is a perspective view of the stand portion in extended and collapsed configurations.

FIG. 9 is a perspective view of the stand portion in extended and collapsed configurations. The button 6 is pushed to move the stand bottom half 7 into and out of the stand top half 5.

Figure 10A:
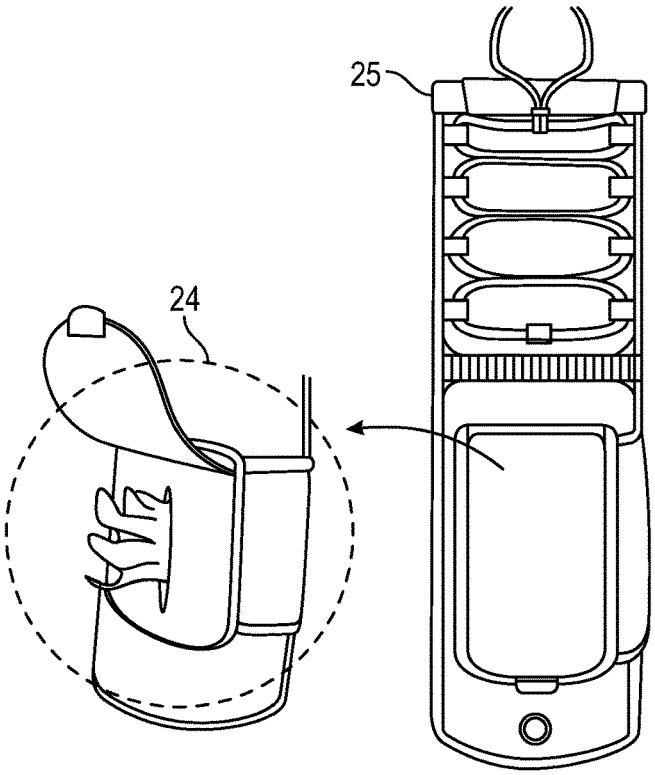
FIGS. 10A and 10B are perspective views of the bag portion of the invention.
Figure 10B:
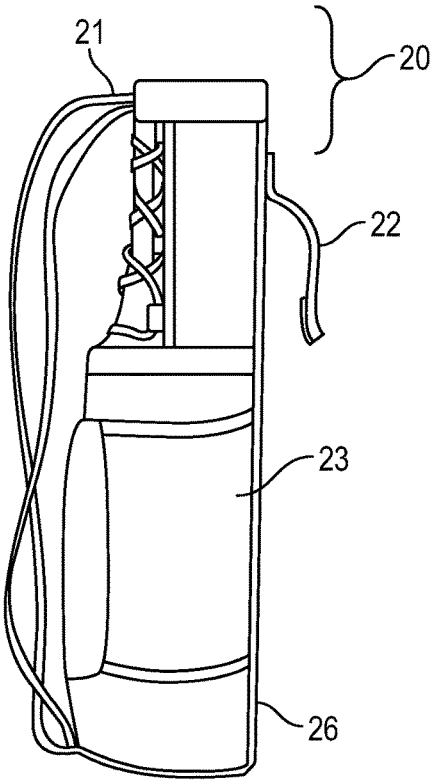

FIGS. 10A and 10B are perspective views of the bag portion of the invention. The bag, generally referenced as 20, has a bag body portion 26 and a bag top 25, which is opened and closed by a drawing strings 21. The bag body has a belt loop 22, that can be used to removably attach the bag to a belt loop or onto a backpack when hiking. The bag body also has a tissue dispenser 24 and an extra pocket 23 for storage. The goal of the invention is to provide a comfortable and light weigh toilet seat than can be collapsed into a relatively small bag that is easily carried.

Figure 11A:
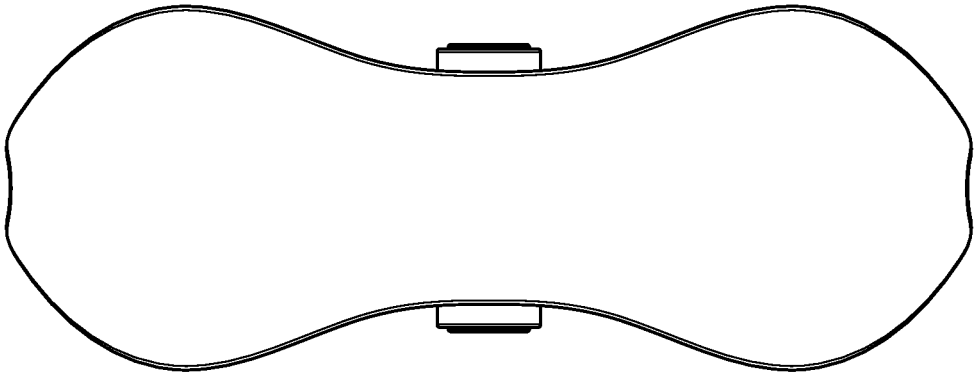
FIGS. 11A, 11B and 11C are top, bottom and side perspective views of the invention showing the location of the LED lights and how the button can be used to adjust the length of the stand portion.
Figure 11B:
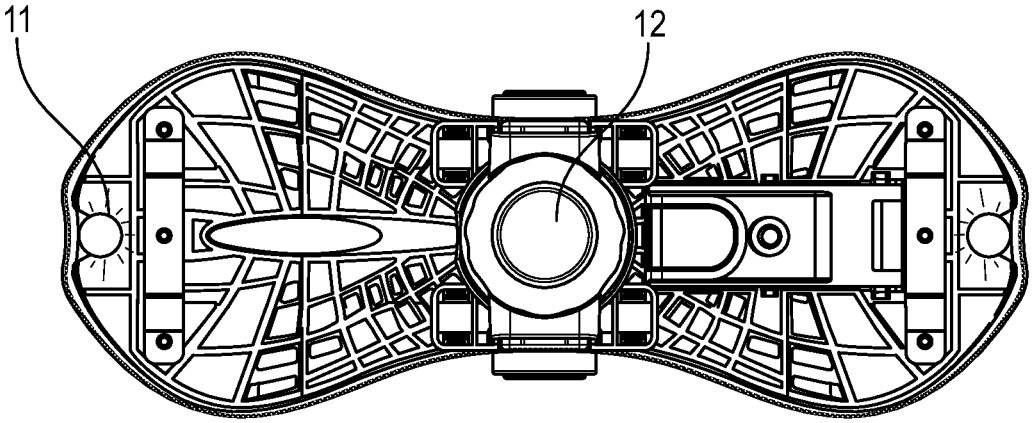
Figure 11C:
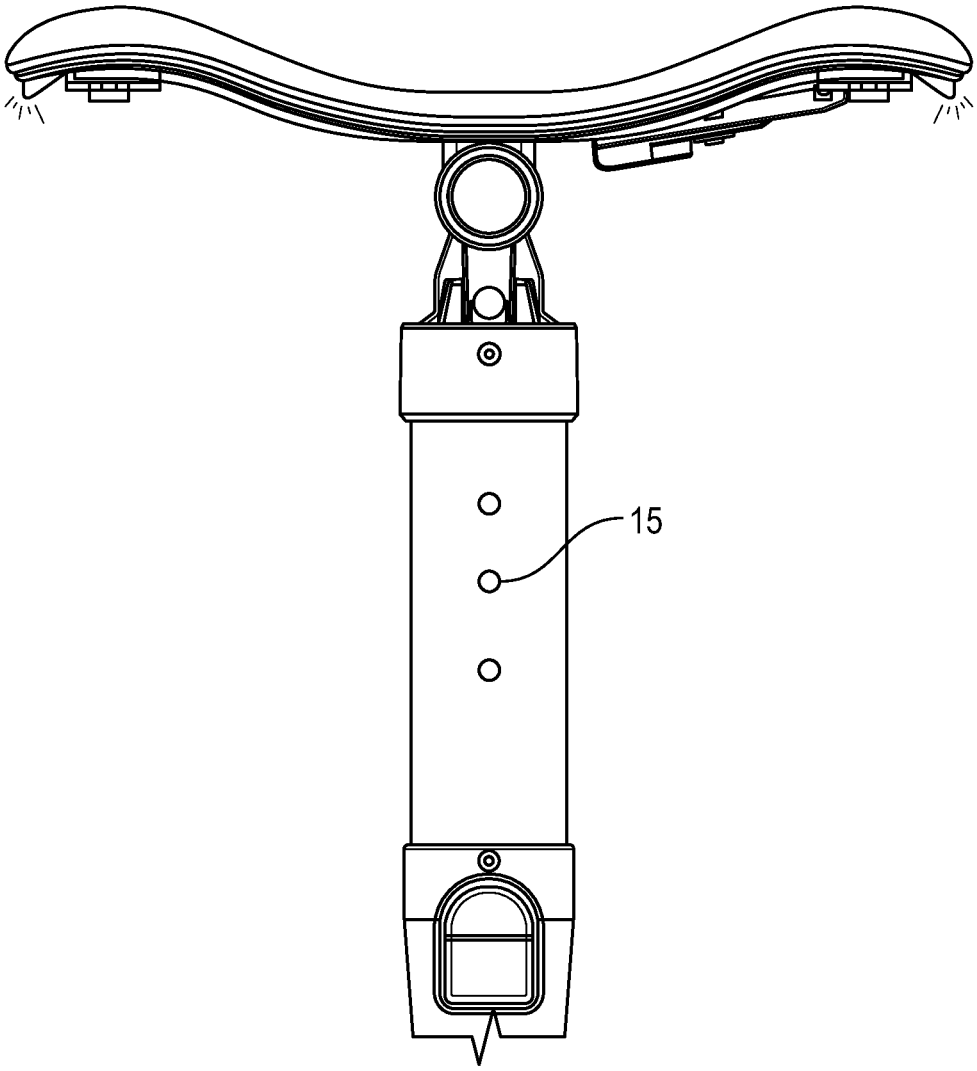

FIGS. 11A, 11B and 11C are top, bottom and side perspective views of the invention showing the location of the LED lights and how the button 6 can be used to adjust the length of the stand portion by removably securing the stand portion into various holes 15. The LED lights are powered by batteries, which can either be installed and replaced in a cavity on the underside of the seat, or be rechargeable batteries that are powered by a solar panel that can either be a separate panel or built into the upper seat surface.

Figure 12:
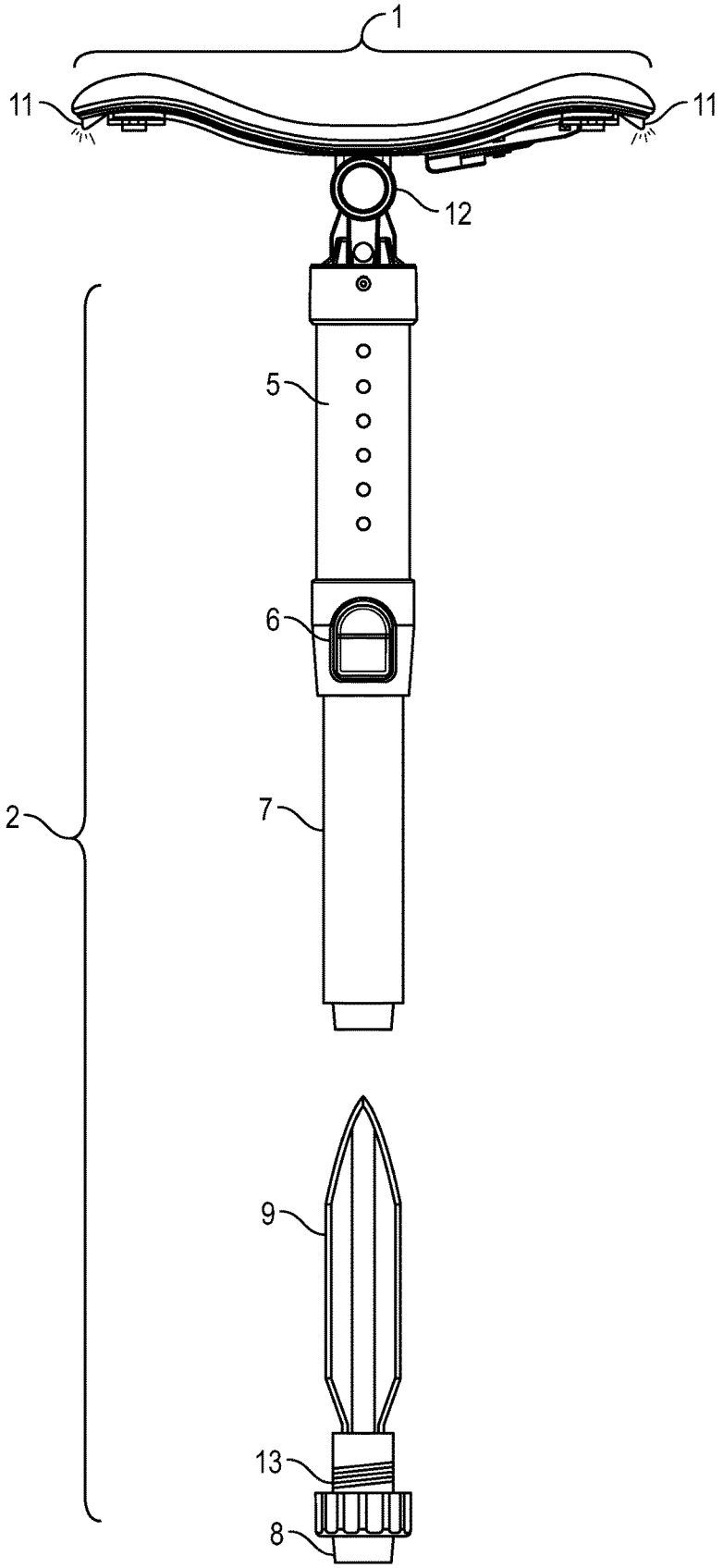
FIG. 12 is an exploded view of the invention showing how the rubber foot can be removed and how the trowel removably attaches to the stand portion.

FIG. 12 is an exploded view of the invention showing how the rubber foot 8 can be removed and how the trowel 9 removably attaches to the stand portion through trowel threads 13 that screw into lower stand portion threads (14 in other illustrations) to create a "shovel" device for digging holes.

Figure 13:
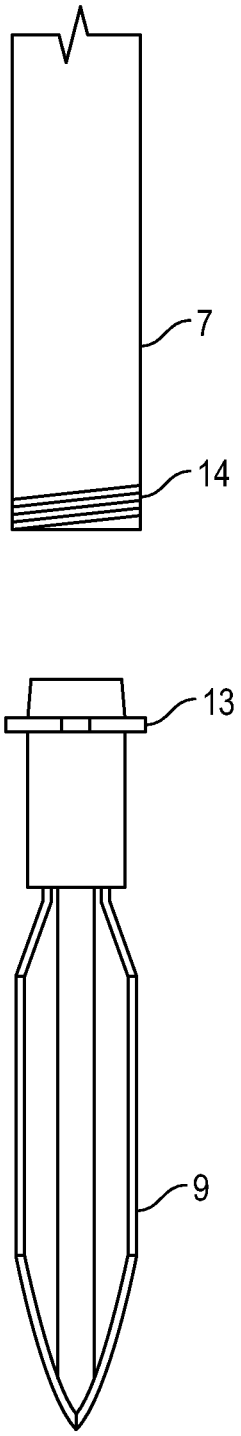
FIG. 13 is a side view showing how the trowel can be removably screwed into the stand portion.

FIG. 13 is a side view showing how the trowel 9 can be removably screwed into the stand bottom half 7 through trowel threads 13 that screw into lower stand portion threads 14 to create a "shovel" device for digging holes.

As a basic summary, the invention has two basic parts: a seat portion, 1 generally, and a stand portion, 2 generally, rotably attached to each other by a turning knob 3. The stand portion, 2 generally, has a stand top half 5 and a stand bottom half 7, where the stand bottom half 7 telescopically fits into the stand top half 5, and is adjustable via a button 6 which allows a user to adjust to stand to different heights through lining up the button with a variety of holes 15. At the bottom of the stand bottom half 7 is a removable rubber foot 8. The rubber foot 8 can be removed, and it has on its other end, a trowel 9 and a section of trowel threads 13 which can mate with with another section of threads on the inside of the lower stand, which are referred to as lower stand portion threads 14. On the bottom of the seat is at least one LED light 11 which provide illumination when using the device at night.

The device can be collapsed and stored into a small bag, generally referenced as 20. The bag 20 has a bag body 29 with a bag top 25. Draw strings 21 are used to open and close the bed top 25. On sides of the bag body 29 are a belt loop 22, an extra pocket 23, and a tissue pocket/dispenser 24.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

We claim:

1. A portable toilet assembly consisting of: a seat portion connected to a stand portion, and a bag portion, where the seat portion and the stand portion are rotably connected by a turning knob at a hinge point on an underside of the seat portion, where the seat portion and the stand portion are removably insertable into the bag portion, where the seat portion consists of a seat, with a seat top and a seat bottom, where the seat bottom consists of a support understructure and two retaining brackets, where at least two support rods connect a swivel bracket on the turning knob to at least one of the two retaining brackets, where the stand portion consists of a stand top half and a stand bottom half, where the stand bottom half fits telescopically inside the stand top half, where the stand top half has a button, where the button can adjust a location of the stand bottom half in the stand top half by clipping into one of a plurality of holes in the stand bottom half, where the bag portion consists of a bag body, a belt loop, an extra pocket, a tissue product dispenser, and a bag top, where the bag top can be closed through one or more drawstrings.

2. The portable toilet assembly of claim 1, where the number of support rods is two, and each of the two support rods extends from a first retaining bracket of the two retaining brackets, through the swivel bracket, to a second retaining bracket of the two retaining brackets.

3. The portable toilet assembly of claim 1, where the number of support rods is four, and each of the four support rods extends from one of the two retaining brackets, to the swivel bracket, where it is retained by a swivel bracket retainer.

4. The portable toilet assembly of claim 3, where each support rod has a flat rod portion that connects to the swivel bracket, a 90-degree connector, an upright rod portion, and a catch portion, where the catch portion attaches to one of the two retaining brackets.

5. The assembly of claim 1, where the stand bottom half additionally comprises an end portion having a trowel, where the trowel comprises a rubber end and a plurality of trowel threads, there the plurality of trowel threads mate with a plurality of stand bottom half threads, where the plurality of stand bottom half threads are located on an inner surface of the stand bottom half, such that the trowel can be screwed into a bottom end of the stand bottom half.

6. The assembly of claim 5, where the seat has a seat top portion and a seat bottom portion, and the bottom portion comprises at least one LED light.

7. The assembly of claim 6, where the trowel is removably attached to the stand bottom half by a locking ring, and where the stand bottom half is attached to the stand top half by a button detent and hold system.

8. A portable toilet assembly comprising: a seat portion connected to a stand portion, and a bag portion, where the seat portion and the stand portion are rotably connected by a turning knob at a hinge point on an underside of the seat portion, where the stand portion comprises a stand top half and a stand bottom half, where the stand bottom half fits telescopically inside the stand top half, where the stand top half has a button, where the button can adjust a location of the stand bottom half in the stand top half by clipping into one of a plurality of holes in the stand bottom half, where the stand bottom half additionally comprises an end portion having a trowel, where the trowel comprises a rubber end and a plurality of trowel threads, there the plurality of trowel threads mate with a plurality of stand bottom half threads, where the plurality of stand bottom half threads are located on an inner surface of the stand bottom half, such that the trowel can be screwed into a bottom end of the stand bottom half, where the seat has a top portion and a bottom portion, and the bottom portion comprises at least one LED light.

9. The assembly of claim 8, where the bag portion comprises a bag body and a bag top, where a plurality of drawstrings open and close the bag top.

10. A portable toilet assembly comprising: a seat portion connected to a stand portion, and a bag portion, where the seat portion and the stand portion are rotably connected by a turning knob at a hinge point on an underside of the seat portion, where the seat portion and the stand portion are removably insertable into the bag portion, where the seat portion comprises a seat, with a seat top and a seat bottom, where the seat bottom consists of a support understructure and two retaining brackets, where at least two support rods connect a swivel bracket on the turning knob to at least one of the two retaining brackets, where the stand portion comprises a stand top half and a stand bottom half, where the stand bottom half fits telescopically inside the stand top half, where the stand top half has a button, where the button can adjust a location of the stand bottom half in the stand top half by clipping into one of a plurality of holes in the stand bottom half, where the bag portion comprises a bag body, a belt loop, an extra pocket, a tissue product dispenser, and a bag top, where the bag top can be closed through one or more drawstrings.

11. The portable toilet assembly of claim 10, where the number of support rods is two, and each of the two support rods extends from a first retaining bracket of the two retaining brackets, through the swivel bracket, to a second retaining bracket of the two retaining brackets.

12. The assembly of claim 11, where the seat has a top portion and a bottom portion, and the bottom portion comprises at least one LED light.

13. The portable toilet assembly of claim 10, where the number of support rods is four, and each of the four support rods extends from one of the two retaining brackets, to the swivel bracket, where it is retained by a swivel bracket retainer.

14. The portable toilet assembly of claim 13, where each support rod has a flat rod portion that connects to the swivel bracket, a 90-degree connector, an upright rod portion, and a catch portion, where the catch portion attaches to one of the two retaining brackets.

15. The assembly of claim 13, where a trowel is removably attached to the stand bottom half by a locking ring.

16. The assembly of claim 10, where the stand bottom half additionally comprises an end portion having a trowel, where the trowel comprises a rubber end and a plurality of trowel threads, there the plurality of trowel threads mate with a plurality of stand bottom half threads, where the plurality of stand bottom half threads are located on an inner surface of the stand bottom half, such that the trowel can be screwed into a bottom end of the stand bottom half.

* * * * *